US006145235A

United States Patent [19]

Emerson et al.

[11] Patent Number: 6,145,235

[45] Date of Patent: Nov. 14, 2000

[54] RAMROD FOR A MUZZLE-LOADING FIREARM

[75] Inventors: Ashley C. Emerson, Weatherford, Tex.; Ralph M. Lermayer, Alamogordo, N. Mex.; Edward W. Pastusek, Ft Worth, Tex.

[73] Assignee: Ashley Outdoors, Inc., Fort Worth, Tex.

[21] Appl. No.: 09/071,753

[22] Filed: May 1, 1998

[51] Int. Cl.[7] ..... F41C 27/00

[52] U.S. Cl. ..... 42/90; 42/51; 42/95

[58] Field of Search ..... 42/90, 51, 95

[56] References Cited

U.S. PATENT DOCUMENTS

| | | | |
|---|---|---|---|
| 1,665,988 | 4/1928 | Smith | 15/104.165 |
| 2,379,962 | 5/1945 | Hoerle | 15/104.2 |
| 2,834,973 | 5/1958 | Friesen | 15/104.165 |
| 3,208,302 | 9/1965 | Lewis et al. | 74/548 |
| 3,402,950 | 9/1968 | Hertzberg | 15/104.2 |
| 4,407,086 | 10/1983 | Hasselman | 42/90 |
| 4,843,747 | 7/1989 | Echeberria | 42/90 |
| 4,875,303 | 10/1989 | DeWeert et al. | 42/90 |
| 4,890,406 | 1/1990 | French | 42/90 |
| 4,899,415 | 2/1990 | Wheeler | 15/104.05 |
| 4,930,204 | 6/1990 | Bice | 42/95 |
| 5,127,179 | 7/1992 | Marsh | 42/90 |
| 5,204,483 | 4/1993 | Tellechea | 42/95 |
| 5,379,542 | 1/1995 | Guzman | 42/95 |
| 5,404,666 | 4/1995 | Cline, Jr. | 42/90 |
| 5,416,940 | 5/1995 | Bandera | 7/118 |
| 5,657,570 | 8/1997 | Emmanuel | 42/95 |

*Primary Examiner*—Stephen M. Johnson
*Attorney, Agent, or Firm*—Charles W. McHugh

[57] ABSTRACT

An improved ramrod having utility in preparing a firearm for firing, said firearm being of the type that uses black powder as a propellant and is sometimes called a muzzleloader. The ramrod has an elongated body of substantial rigidity so that it may function to tamp a bullet prior to igniting a charge of black powder. A folding arm is permanently attached to and carried by the "outer" end of the elongated body. The folding arm has a stowed position in which the arm is generally aligned with the body's longitudinal axis. The arm also has a working position in which it makes a substantial angle (e.g., 90 degrees) with respect to the body's longitudinal axis. The attachment of the folding arm to the elongated body is by a pivot pin having an axis of rotation that is perpendicular to the body's longitudinal axis. A force may be transferred to the body by manually applying said force to the arm while the arm is in its working position. The permanent attachment of the arm to the elongated body ensures that the arm cannot become separated from the elongated body and lost. A transverse bore is preferably provided in each accessory, so that it may be tightened or loosened with respect to the elongated body. When an accessory has a protruding stud with a diameter that is essentially the same size as the transverse bore, then the stud on one accessory can be used to install or remove another accessory.

22 Claims, 4 Drawing Sheets

RAMROD FOR A MUZZLE-LOADING FIREARM

FIELD OF THE INVENTION

This invention relates generally to muzzle-loading firearms (also commonly referred to as black-powder firearms and/or simply as muzzleloaders), regardless of their length, including long guns (e.g., guns described as muskets, carbines, shotguns and rifles) and handguns (e.g., pistols), provided that they are prepared for firing by manually inserting a charge of black powder (or an equivalent propellant) and a projectile (bullet) into the forward end of the firearm's barrel. More particularly, the invention relates to an improved ramrod for such a firearm, said ramrod being an elongated member that is primarily used to tamp a bullet on top of a charge of propellant that has been poured into the firearm's bore while the barrel is held in a generally vertical manner.

BACKGROUND OF THE INVENTION

Black-powder firearms, also known as muzzleloaders, etc., have a long and colorful history going back for several hundred years. In general such firearms have a barrel with a forward end (commonly referred to as the muzzle) that is always open, and an almost closed second end that can receive and hold a charge of black powder (i.e., gunpowder) or its equivalent. When the propellant being used is in the form of loose powder, it must be poured into the barrel every time that the firearm is to be fired. A significant quantity of the black powder is usually carried by the shooter in a flask or similar holder that has a relatively small, funnel-like opening; the narrow opening fosters directional control of the powder as it is being poured into the muzzle end of a barrel that is being held with a generally vertical orientation. After the powder has been placed in the barrel, a bullet whose diameter is usually just slightly less than the diameter of the barrel's bore is placed on top of the powder. (As used herein the word "bullet" will be used in a generic sense, without regard to its shape; hence, it should be appreciated that spherical balls, conical slugs, so-called "minies," sabots and other projectile shapes are all intended to be encompassed by the single word "bullet.") To ensure that there is a tight fit between the bullet and the bore, it is common to at least partially wrap some bullets with a small piece of cloth, commonly referred to as a patch. The patch may be used in an essentially natural condition (i.e., it may be relatively dry) or it may be lubricated in some way—to improve the ease with which the bullet can be pushed down into the barrel with an elongated rod, commonly called a ramrod.

In view of the fact that a ramrod must be used every time that the firearm is to be fired, is is logical for the ramrod to be stored with or carried by the firearm. Usually the storage location is an elongated cavity immediately below and parallel to the firearm's barrel. Such as arrangement is shown in FIG. 1, which is a side elevation view of an antique Harpers Ferry flintlock rifle, many of which were used in the U.S. Civil War. The muzzle for another rifle is shown in FIG. 2, which clearly shows the firearm's bore and the exposed, outer end of a ramrod that is routinely stowed under the barrel. Because of space limitations that are established by the adjacent barrel, both ends of the ramrod must be kept relatively small, and they will typically have a diameter that is about the size of the firearm's bore. Unfortunately, the small ends of a typical ramrod make it hard to use the ramrod in the three ways that a ramrod is commonly used, i.e., as a straight "pusher," a straight "puller," and as a device to apply torque to the end that is inserted into the firearm's bore.

When being used as a straight pusher, the first end of the ramrod is inserted into the firearm's bore until it comes into contact with a bullet that has already been inserted into the bore. A straight longitudinal force is then applied to the bullet by pushing downward on the head of the ramrod (i.e., the exposed or second end of the ramrod). Depending on the relative sizes of the bore and the bullet and the patch, as well as the amount of residue that may have accumulated in the bore from previous shots, the amount of force that is required to properly seat a bullet can vary from mild to severe. And when the shooter is using his or her muzzle-loader in hunting, the compelling need to quickly fire a second shot at a deer or the like will often cause a hunter to get excited and push too hard on the head of the ramrod. With ramrods whose elongated bodies are made of wood, there is always a risk that too much longitudinal force will cause the wood to fracture. Even if the ramrod doesn't break and cause the equivalent of a large splinter to be driven into a forearm, a shooter can experience some definite pain on the palm of his or her hand. This is because forcefully striking a ramrod whose head has a diameter of about ⅜ this inch can often apply a pressure on the palm of many pounds per square inch.

Another example of routine use of a ramrod is as a straight puller. It has sometimes happened that a shooter places a first bullet in a bore and then gets distracted by something; he or she may forget that a bullet has already been inserted, and then places a second bullet on top of the first one. The inner end of the barrel is essentially closed, so that neither the first nor the second bullet can be seen. Indeed, the presence of the second bullet will likely be discovered only by observing that the ramrod will not go far enough into the bore during the second tamping action. It then becomes necessary to extract the second bullet—often after it has become wedged in the bottom of the bore by the tamping force applied by the ramrod. (Bullets for black-powder firearms are made of lead, and they are soft enough so that they can be deformed under pressure, which is why a second bullet will not simply fall out of an inverted barrel.) Extraction can usually be accomplished by using a small and generally conical member that is externally threaded (somewhat like a woodscrew) at the first end of an elongated member; a ramrod with an extractor substituted for the bullet-tamping end can serve this purpose nicely. The procedure involves placing the modified ramrod (with the pointed extractor attached thereto) into the bore, bringing it into contact with the second bullet, and rotating the ramrod about its longitudinal axis. With some skill, a reasonable amount of patience, and perhaps a little bit of luck, the generally conical member can be screwed into the second bullet. Then, pulling outward—longitudinally—on the ramrod can usually bring out both the ramrod and the second bullet.

Another situation can arise when a shooter inadvertently pushes a bullet down into a barrel without first putting in a charge of powder as the planned propellant. Creating a spark at the firearm's breech will then have no effect, because there is essentially nothing to ignite. The bullet must then be extracted in the same way that was described above, using an extractor at the forward end of a rod that is essentially as long as the firearm's bore.

If there is difficulty in engaging a stuck bullet with a bullet extractor, it usually is necessary to apply an increased downward force on the bullet, and also apply a significant amount of torque to the elongated member (and its attached extractor). But many people do not have enough gripping force in their hands to grab the exposed end of a narrow cylindrical member and twist it into a stuck piece of lead. Hence, it is sometimes necessary for a hunter to cut short a hunting excursion until he or she can get back to camp where a T-handled extraction tool can be obtained. This can not only take unwanted time out of a hunting trip, it can also lead to personal frustration and aggravation—and perhaps increased blood pressure on the part of the hunter. It would be nice, maybe, to anticipate such a difficulty—and carry a tool box into the field with all of the repair and service tools that might sometime be needed. But there are at least some purists who would look with disdain on anyone who took excessive precautions when going into the field with their muzzleloaders—and weighed themselves down with repair tools and hardware, etc. Such purists might say, "That's not the way Davy Crockett would have done it."

It is entirely possible that there have been people who recognized that it would be better if there could be improvements in dealing with the three conditions described above with respect to ramrods, i.e., the need for easier "pushing-in," improved "pulling-out," and a greater ability to apply torque to a ramrod. But if there were people who recognized these problems at all, they have likely just said to themselves, "Well, that's just what you have to endure when you want to enjoy the sport of shooting muzzleloaders." However, one purpose of this disclosure is to teach that it is not necessary to passively accept the three "problems" described above. This is especially true when it is recognized that the invention described herein can minimize, if not eliminate, the three conditions or problems associated with ramrods of the prior art. It is a goal of this disclosure, therefore, to describe a new configuration for a ramrod in such a way that those skilled in muzzle-loading firearms will fully understand the concept, and will readily appreciate the uses to which it may be put.

BRIEF DESCRIPTION OF THE INVENTION

In brief, the improved ramrod disclosed herein is designed for use with essentially any muzzleloader that uses black powder (or its equivalent) to propel a bullet upon ignition of the powder—as long as the ramrod's length and diameter are properly sized so as to be compatible with a particular firearm. The ramrod is useful in preparing a firearm for firing and, optionally, cleaning the firearm after it has been fired, as well as helping to extract a bullet that has become inadvertently wedged in the firearm's barrel.

The ramrod has a long, thin, substantially rigid body with first and second ends and a longitudinal axis that extends between the two ends; the distance between the first and second ends defines the ramrod's length. The ramrod's length is established so as to be approximately the same as the length of the firearm's bore, which can be as short as 9 inches for a handgun or about 46 inches for a long gun. The ramrod's body is generally cylindrical, and it has an exterior size and shape that permits it to be temporarily inserted into the bore, as well as being stored in an elongated storage compartment below the barrel. The ramrod's first end is adapted for insertion into the bore of a firearm in order to tamp a bullet prior to igniting a charge of powder in the firearm. In these respects, the new ramrod can be considered to be about the same as ramrods of the prior art.

But what is significant about the new ramrod is that it has a folding arm that is attached to and permanently carried by the second end of the ramrod, i.e., the end that remains exposed after the first end has been inserted into either the bore or the elongated storage compartment. The arm may be said to be characterized by having both a stowed position and a working position. When in its stowed position, the arm is generally aligned with the longitudinal axis of the ramrod, and it will usually lie just ahead of the firearm's elongated storage compartment—where it can be grabbed and manipulated by a shooter. When the arm is in its working position, it will make a substantial angle (e.g., about 90 degrees) with respect to the longitudinal axis of the ramrod. When in its working position torque may be manually exerted on the ramrod by applying a transverse force to the arm; also, a longitudinal force may be applied to the ramrod by exerting a force on the arm in a direction that is parallel to the longitudinal axis of the ramrod. There is also optionally provided a biasing means for normally holding the arm in its stowed position—except when the arm has been manually forced away from its stowed position.

BRIEF DESCRIPTION OF THE SEVERAL FIGURES OF THE DRAWINGS

Figure 16:
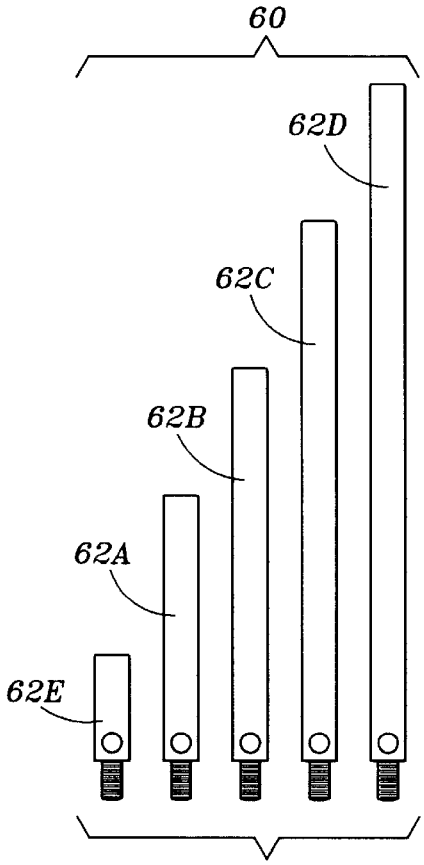
Figure 17:
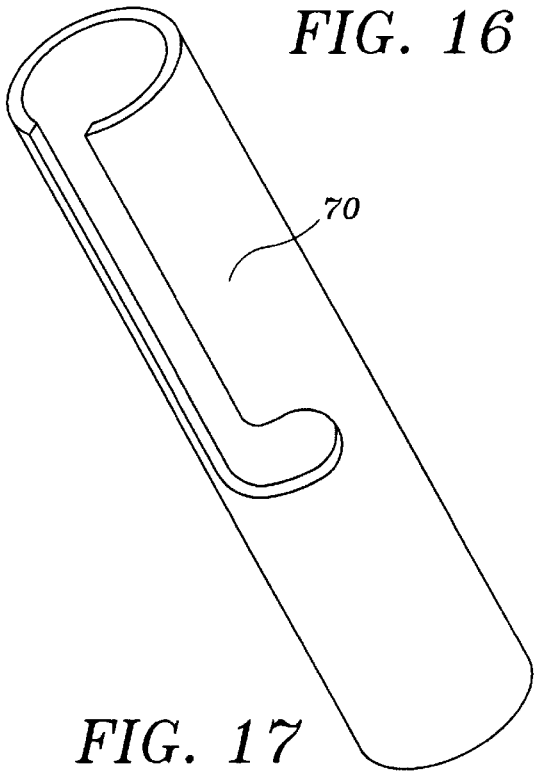

FIG. 16 is an elevational view of a set of elongated members that can be selectively joined together, end to end, with threaded connections to create a ramrod of a desired length, said set of members serving as what may be thought of as the building blocks for an essentially "universal" ramrod that can be carried by many hunters or shooters as a "backup" in case their primary ramrod should break; and FIG. 17 is a perspective view of a separable member that is tube-like and that can be selectively associated with the folded arm—to further increase the area against which a manual force can be applied, thereby lowering the pressure on a user's hand.

DETAILED DESCRIPTION OF A PREFERRED EMBODIMENT OF THE INVENTION

Referring to FIGS. 3, 4, 5 and 6 the new ramrod 20 has an elongated body 22 made of a selected material (e.g., steel, aluminum, brass, a reinforced carbon composite, or a tough plastic) that will provide ample strength for transmitting longitudinal forces—as well as transmitting torque when a twisting force is applied at one end. The body has a first end 24 that is designed to be inserted into the bore of a muzzle-loading firearm during the step of tamping a bullet; and the body has a second end 26 that normally remains outside the bore at all times where it may be selectively grasped by a shooter. The length of the body 22 is chosen so as to be compatible with the particular muzzleloader with which it will be used. For example, in the case of the REMINGTON 700 ML (which is a muzzle-loading version of the well-known REMINGTON 700 rifle), the ramrod's body 22 will be about 20 inches long. Aesthetics and tradition may dictate that a ramrod's length be such that the ramrod's second end be covered by the firearm's barrel. But as far as operating the firearm is concerned, there would seem to be no reason why a ramrod might be stowed in such a way that its second end might come to rest just slightly in front of the firearm's muzzle.

Figure 1:
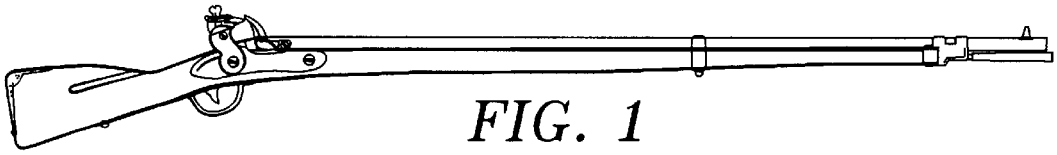
FIG. 1 PRIOR ART
FIG. 1 is an elevation view of an exemplary muzzle-loading firearm, circa 1862.
Figure 2:
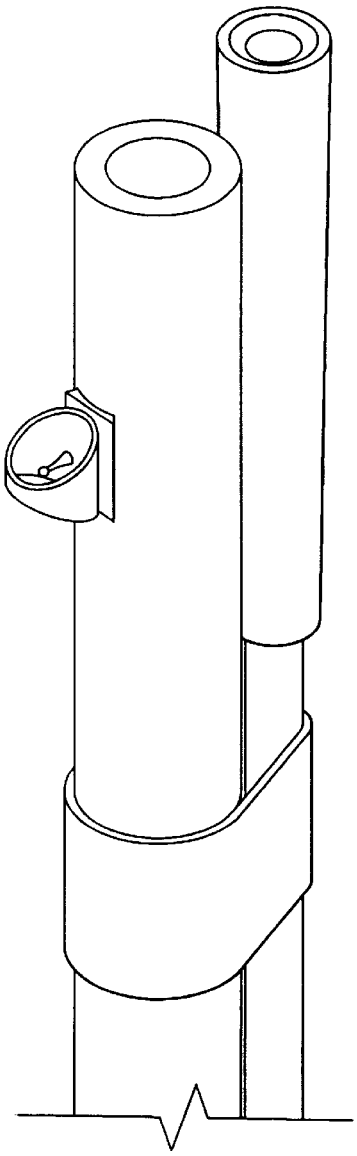
FIG. 2 PRIOR ART
FIG. 2 is a fragmentary view of the forward end of an exemplary muzzle-loading firearm, showing a ramrod of the prior art.
Figure 5:
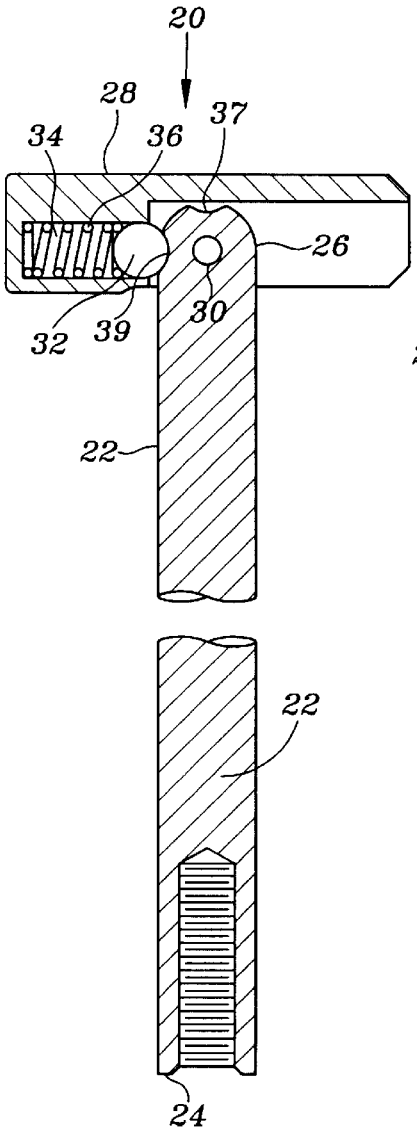
FIG. 5 is a fragmentary elevational view of the "arm" end of the ramrod, partially cross-sectioned and at a different scale than FIG. 3, to more readily show a biasing means for holding the arm in its "folded out" configuration.
Figure 6:
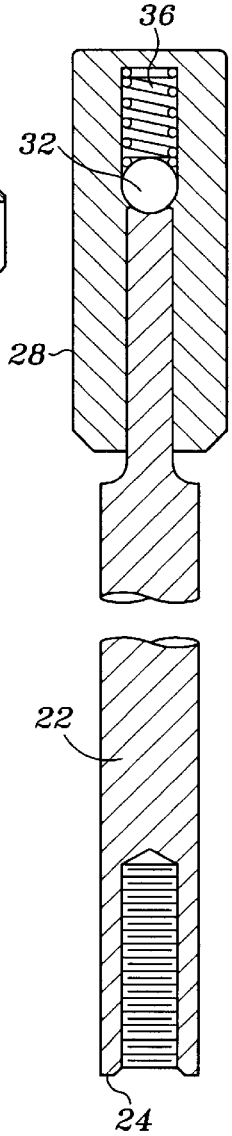
FIG. 6 is a fragmentary elevational view of the "arm" end of the ramrod, partially cross-sectioned and at a different scale than FIG. 4, to more readily show the biasing means as it holds the arm in its "stowed" configuration.
Figure 3:
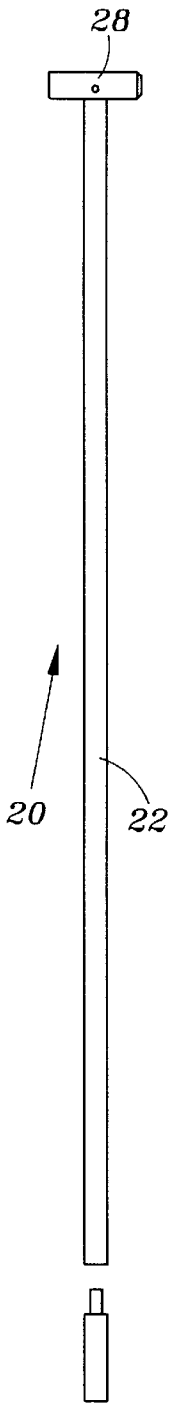
FIG. 3 is an elevational view of a ramrod in accordance with the invention, with an arm being shown as folded outwardly to its "working" position.
Figure 4:
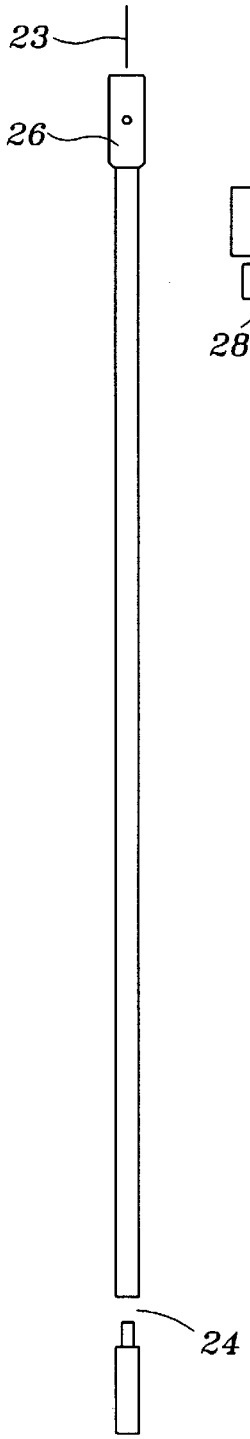
FIG. 4 is an elevation view similar to FIG. 3 but showing the arm folded inwardly, such that the arm is aligned with the longitudinal axis of the ramrod—to produce a more compact configuration, i.e., a configuration that permits the ramrod to be readily "stowed" under the barrel of the firearm.

Attached to the body's second end 26 is a rigid arm 28 that is mounted so that it may be selectively folded with respect to the ramrod's body. In FIG. 3 the arm is shown in what may be aptly called its working position, wherein it makes a substantial angle (e.g., 90 degrees) with respect to the ramrod's longitudinal axis 23. In the preferred embodiment the arm 28 folds about a central axis that is defined by a metal pin 30 that passes transversely through the arm and through the body's second end. But if desired, an arm might be be pivotally mounted with respect to the ramrod's body with a pin that passes transversely through one end of the arm rather than its middle. In FIG. 4, the arm is shown in its stowed position, wherein it is generally aligned with the ramrod's longitudinal axis 23.

Optionally, the arm 28 may be biased to either its stowed position or its working position, or both (at alternate times), by use of a spring-loaded ball 32 that is provided in the arm. A longitudinal passage 34 is first drilled into the arm from one end, with the other end of the arm remaining closed. A coiled spring 36 is then placed in the passage, and the ball 32 is then dropped into the passage where it comes to rest on top of the spring. The combined length of the spring in its rest condition and the ball is greater than the distance between the bottom of the passage 34 and the pin 30; as a result, the spring 36 must be compressed in order to provide clearance in front of the ball to install the pin. The compressed spring 36 continuously urges the ball "outwardly," i.e., toward the open end of the passage and toward the open end of the arm.

Figure 7:
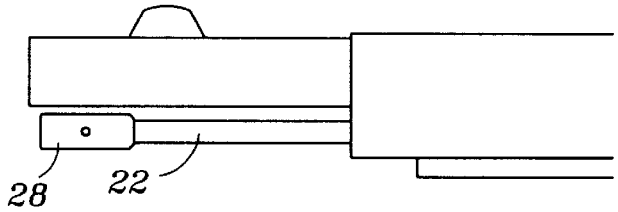
FIG. 7 is an elevational view of the muzzle of a firearm, with the ramrod being oriented in such a way that the proximity of the barrel will prevent the arm from being accidentally rotated away from its stowed position adjacent the barrel.

The complementary part of a biasing means for holding the arm at a fixed position with respect to the ramrod's body is present on the second end of the ramrod—where two recesses 37, 39 are provided, both of which lie in a plane that passes through the passage 34. The first recess 37 is aligned with the longitudinal axis of the ramrod's body; and when the arm has been rotated so that the ball 32 is urged against this recess, the arm will be held in what is called its stowed position. The second recess 39 is located 90 degrees away from the first recess, on a side of the ramrod's second end; and when the arm 28 has been rotated so that the ball 32 is urged against this second recess, the arm will be held in what is called its working position. As will be more fully explained hereinafter, the arm 28 may also be held in the equivalent of a stowed configuration by virtue of adjusting the orientation of the ramrod when it has been stored on the firearm. That is, when the ramrod has been placed in the firearm's storage compartment in such a way that the arm 28 cannot rotate upwardly (because of spatial interference with the adjacent barrel), the arm may be considered to be safely stowed, regardless of whether a biasing means is provided. This relationship has been illustrated in FIG. 7.

Figure 8:
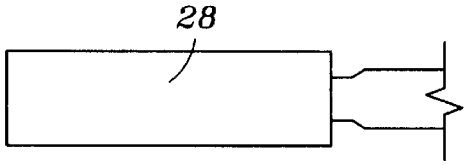
FIG. 8 is a view of the "arm" end of the ramrod, taken in a plane that is 90 degrees with respect to that of FIG. 5, showing what will be referred to as the top of the arm.

When in its working position, the arm 28 will provide a substantial area against which a shooter's palm may be pressed—so that the ramrod may be more readily pushed into the firearm's bore. It can be accurately said that pushing a ramrod will be easier when a shooter is pushing on a transversely oriented arm because the shooter's threshold of pain is not likely to be reached when he or she is pushing downwardly on the relatively wide arm—while the pain threshold could be reached when pushing downwardly on the much smaller rod. This substantial "pushing" area (indicated in FIG. 8, which is a top view of the arm) is almost as large as one-half of the circumferential area of a cylinder whose diameter is indicated in FIG. 8. In the preferred embodiment, the diameter of the aluminum arm is 0.44 inch, while its length is about 1.5 inches. The preferred ramrod body is also made of aluminum (e.g., aircraft-grade 7075 aluminum), and its diameter is 0.360 inch.

Figure 9:
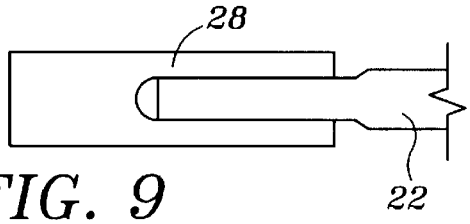
FIG. 9 is another view of the "arm" end of the ramrod, taken in a plane that is 90 degrees with respect to that of FIG. 5, showing what will be referred to as the bottom of the arm.
Figure 10:
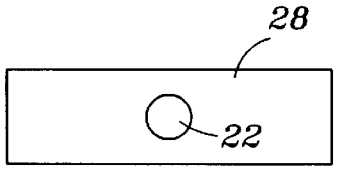
FIG. 10 is a drawing that suggests the improvement that can be expected when applying a downwardly directed longitudinal force on the ramrod—by showing the increase in area against which the longitudinal force will be applied.

FIG. 9 shows a bottom view of the arm 28 when it has been rotated to its working configuration, and FIG. 10 is a drawing that clearly contrasts the difference in working area between the arm and the ramrod body. The benefit of this increase in working area is almost as great when the rod is to be manually pulled out of a firearm's bore instead of being pushed into the bore. The arm 28 also permits a significant amount of torque to be manually applied to the second end of the ramrod, which torque can be particularly useful in extracting a bullet that is stuck in the bottom of a firearm's bore. Such that an extractor that has been installed in the rod's first end 24 can more readily "bite" into a stuck bullet. Once the bullet has been fully engaged by the extractor, the arm 28 in its "tee" mode makes it relatively easy to pull outward on the ramrod and remove the stuck bullet. Without the arm 28 in its working configuration, a shooter would have to try to grip the top of a linear ramrod with enough force (using a thumb and one or two fingers) to be able to pull upwardly on it.

Figure 11:
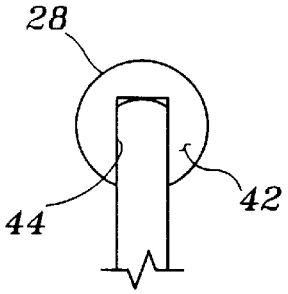
FIG. 11 is an elevational view of the "arm" end of the ramrod, showing what will be referred to as the open end of the arm.
Figure 12:
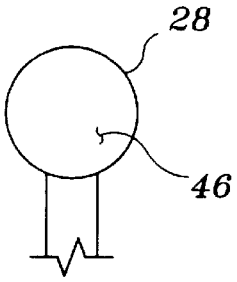
FIG. 12 is an elevational view of the "arm" end of the ramrod, showing what will be referred to as the closed end of the arm.
Figure 13A:
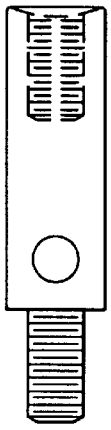
FIGS. 13A–13D are elevation views of a set of four tips, each of which has utility at one time or another in the sport of shooting a muzzleloader, and each of which has a threaded stud that can mate with a longitudinally threaded bore in the first end of the ramrod.
Figure 13B:
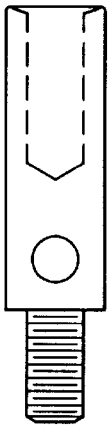
Figure 13C:
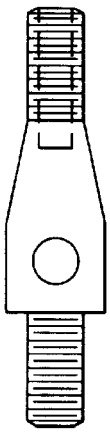
Figure 13D:
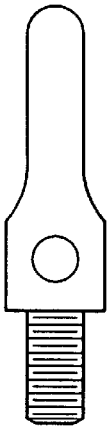

For completeness, FIGS. 11 and 12 show the two ends of the arm 28. The arm's open end 42 reveals a wide slot 44 that is sized to closely envelop the top end of the ramrod when the arm is rotated to its stowed configuration. The arm's closed end 46 is shown in FIG. 12.

Figure 14:
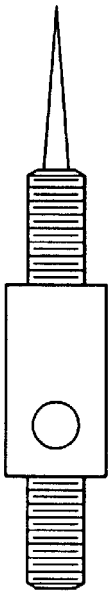
FIG. 14 is an elevational view of an extractor tip that can be selectively threaded onto the front end of the ramrod—for removing bullets that have become inadvertently stuck in the bore of a firearm.

In the case of ramrods of the prior art, e.g., U.S. Pat. No. 4,890,406 to French entitled "Ramrod," the first end usually has a fixed configuration. For example, in order to tamp spherical balls in the bottom of a firearm's bore, a ramrod's first end will typically be concave. And, for cleaning a firearm's bore, a metallic cleaning rod will often have a relatively thin blade with a large transverse opening to receive and hold a folded cleaning patch. For extracting a ball from the closed end of the bore, the first end of a completely different elongated rod will usually have an externally threaded extractor. But rather than having a variety of differently configured rods, the ramrod 20 has an internally threaded bore (about ¾ inch deep, with 10–32 threads) in its first end; any one of a variety of specially configured tips or accessories may be provided with a 10–32 stud (designated by the reference numeral 48) and selectively connected with the bore. FIGS. 13A–13D show a variety of exemplary tips, each of which can be selectively affixed to the first end of a ramrod 20. And while U.S. Pat. No. 5,127,179 to Marsh entitled "Muzzle Loading Firearm Loading Kit" teaches a variety of tips or accessories for attachment to a ramrod, the Marsh tips are of different lengths. Therefore, a given one of the tips (19, 20, 21, 22, or 23 shown in Marsh's FIG. 14) could not be affixed to a ramrod that is to be stored on the firearm—without introducing a variation in total length as the shooter switched from one tip to another. In accordance with this invention, all of the tips that a shooter would likely affix to the first end of a ramrod are of the same length, preferably about one inch, so that the total length of the ramrod will remain the same—regardless of which tip has been attached at any given time. For those occasional situations when a stuck bullet is to be extracted, a longer accessory may be temporarily added to the ramrod, and then the accessory would be removed after its job had been accomplished.

Figure 15A:
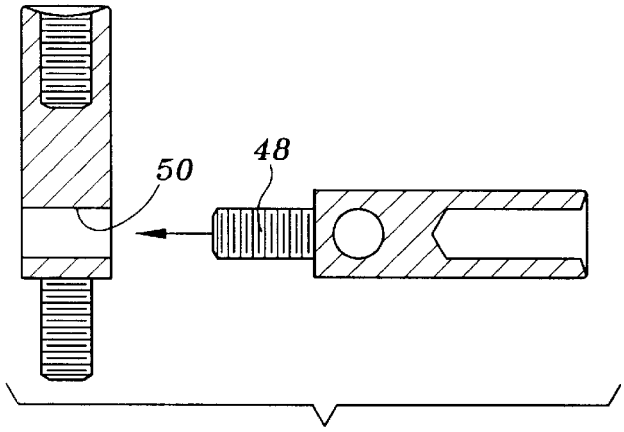
FIGS. 15A and 15B are cross-sectioned views of a pair of tips, showing how the threaded stud of a first tip may be inserted in the smooth bore of a second tip, for the purpose of manually exerting torque on the second tip—to either tighten or loosen the threaded connection between the second tip and the main body of the ramrod.
Figure 15B:
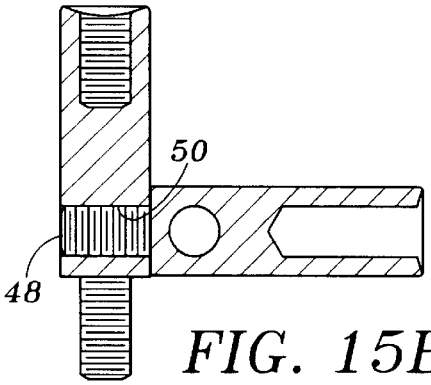

To facilitate mounting and dismounting a selected one of the accessories, a transverse bore 50 is provided in the body of every accessory. Torque may be applied to a given accessory, to tighten or loosen it, by inserting a suitably sized member (equivalent to a wrench) into the smooth hole 50 and twisting the accessory's body. However, instead of requiring that a person carry a separate leverage member (such as a 16 penny nail) in his or her pocket, and running the risk that the leverage member cannot be found when it is needed, it is preferred that the transverse bore 50 be sized to freely accept (preferably with a loose fit) the 10–32 stud that is on every one of the accessories in the set. That is, when the diameter of a 10–32 stud is 0.191 inch, the diameter of the bore is preferably at least 0.192 inch and can be about 0.200 inch. So, when a first accessory has been securely installed on a ramrod, and when there is a desire to substitute a second accessory, the stud 48 of the second accessory is simply inserted into the bore 50 of the first accessory and sufficient torque is applied to loosen the first accessory—so that it can be removed. This relationship is illustrated in FIGS. 15A and 15B. After the second accessory has been loosely threaded onto the ramrod, the roles of the two pieces can be reversed. That is, the stud 48 of the first accessory can be inserted into the bore 50 of the second accessory, and torque may be applied (using a transverse force) to render the new threaded connection secure.

Turning next to FIG. 16, a set 60 of extension members 62A, 62B, 62C, 62D, and 62E is shown, all of which have male threads at one end and complementary female threads at their opposite ends, so that selected ones of them can be joined together, end-to-end, with a first elongated member 64. In total, a set of extension members 60 (or two such sets) and a brass bullet pusher may be connected together to make a ramrod that is essentially as long as is needed to replace a unitary ramrod that has gotten broken. On the other hand, the set 60 can be handled as a compact group of independent extension members—and placed in a relatively short bag and carried in a backpack or the like. (In one sense, a set 60 of extension members may be thought of as an insurance policy to take into the field—to ensure a successful hunt with a muzzleloader.) A careful examination of FIG. 16 will reveal that the respective lengths of the extension members 62A–62E are not identical; indeed, it is preferred that their lengths differ by about one inch, ranging from three, four, five to six inches. By selecting appropriate extension members from one or more sets 60, a ramrod of essentially any desired length can be built up by a shooter. The tightness with which a set of extensions can be joined together can be increased by providing transverse bores in each extension—like the previously described bores 50 in the accessories or tips. And as before, one extension member and its protruding stud can be used in the manner of a wrench to tighten the threaded connection between two other members.

Referring next to FIG. 17, a generally tubular member 70 has an interior that is sized to slip over—and bear against—the exterior of an arm 28, to give the combination more length and hence more opportunity for a person to exert torque on a ramrod. The extra length of the tubular member 70 (as compared with the length of the arm 28) also increases the area against which longitudinal forces may be applied to a ramrod. While it is believed that an increase in the "pushing" or "pulling" area at the top of a ramrod should be a minimum of 100% of the cross-sectional area of a ramrod's body, there is nothing wrong in increasing that area significantly more than 100%, and an auxiliary member 70 can contribute to such an increase.

While only certain preferred embodiments of the invention have been disclosed herein in great detail, those skilled in the art will no doubt recognize that variations in certain sizes, shapes and configurations would be possible—without departing from the general theory of the invention. For example, it is preferred that the folding structural member 28 be larger in diameter than the elongated rod's body 22, but too much larger, or there may not be enough room under the barrel to readily store the combination 22/28 when the structural arm is rotated so as to be longitudinally aligned with the rod. It is preferred, therefore that the arm's transverse cross-sectional area be not more than about 40% larger than the cross-sectional area of the elongated body 22. At the same time, it is preferred that the arm's area against which a manual force may be applied should be at least 100% greater than the transverse cross-sectional area of the rod's body 22. But variations from these preferred spatial relationships might be appropriate in certain circumstances, as those skilled in the art will surely appreciate. Therefore, the invention should be deemed to be measured only by the scope of the claims that are appended hereto.

What is claimed is:

1. An apparatus having utility in preparing a firearm for firing, said firearm being of the type that uses black powder as a propellant and is sometimes referred to as a muzzleloader, and said firearm having a barrel with a forward end and a longitudinal bore, and the firearm also having an elongated storage compartment that lies alongside the firearm's longitudinal bore, comprising:

a) an elongated body having sufficient rigidity to function as a ramrod and having first and second ends, and said body having a longitudinal axis that extends between the first and second ends, and the distance between the first and second ends defining the body's length, and the body's first end being adapted for insertion into the bore of a firearm in order to tamp a bullet prior to igniting a charge of black powder in the firearm, and the elongated body's length being approximately the same as the length of the firearm's bore, and the elongated body having an exterior size and shape that permits it to be temporarily inserted into the bore as well as being stored in the firearm's elongated storage compartment; and b) a folding arm permanently attached to and carried by the second end of the elongated body, said arm having both a stowed position and a working position, and the arm's stowed position being one in which the arm is generally aligned with the longitudinal axis of the body, and the arm's working position being one in which the arm makes a substantial angle with respect to the longitudinal axis of the body, and the attachment of the folding arm to the elongated body being by use of a pivot pin having an axis of rotation that is perpendicular to the longitudinal axis of the body, such that a force may be transferred to the body by manually applying said force to the arm while the arm is in its working position, whereby the permanent attachment of the folding arm to the elongated body ensures that the folding arm cannot become separated from the elongated body where it might become lost.

2. The apparatus as claimed in claim 1 wherein the elongated body has a transverse cross-sectional area that is less than one-quarter square inch, and wherein rotating the arm to its working position presents an external surface against which a force may be manually applied in a direction that is parallel to the longitudinal axis of the body, and said external surface having an area that is substantially larger than the transverse cross-sectional area of the body, whereby manually exerting a force in a direction that is parallel to the body's longitudinal axis results in a pressure on a person's hand that is appreciably lower after the folding arm has been rotated to its working position—as compared with the pressure on a person's hand if the folding arm has not been rotated to its working position.

3. The apparatus as claimed in claim 1 wherein the angle that the folding arm makes with respect to the longitudinal axis of the elongated body when the folding arm is in its working position is about 90 degrees, and wherein torque may be applied to the elongated body by applying a rotating force to the folding arm after the folding arm has been rotated to its working position.

4. The apparatus as claimed in claim 1 and further including a biasing means in the form of a spring for holding the folding arm in at least one of its two positions.

5. The apparatus as claimed in claim 1 and further including a biasing means for holding the folding arm in both of its two positions.

6. The apparatus as claimed in claim 1 wherein the folding arm is held in its stowed position by virtue of a close spatial relationship between the folding arm and the exterior of the barrel's forward end, said close spatial relationship precluding the arm from folding when the plane in which the arm folds is aligned so that it passes through the barrel's forward end, whereby the arm may be effectively captured and held in its stowed position without the need for an auxiliary holding device.

7. The apparatus as claimed in claim 1 wherein the folding arm pivots with respect to the elongated body about an axis that extends transversely through the middle of the arm, such that the arm and the body define a generally T-shape when the arm has been moved to its working position.

8. The apparatus as claimed in claim 1 wherein the folding arm has a generally cylindrical shape with diameter of about 7/16 inch and a length of about 1.5 inches.

9. The apparatus as claimed in claim 8 and further including an extension piece having an interior that is shaped and sized so that it can envelop the generally cylindrical shape of the arm, and the extension piece being longer than the arm, whereby the extension piece can be placed over the arm and can increase the torque that can be applied to the elongated body when a transverse force is applied to the arm in its working position.

10. The apparatus as claimed in claim 1 wherein the folding arm is rotatable between its stowed position and its working position about a metal journal having a diameter of about 1/8th inch.

11. The apparatus as claimed in claim 1 and further including a plurality of attachments, each of which has a useful purpose in the sport of firing a muzzleloaders, and wherein the elongated body's first end has a threaded connection for engagement with a selected one of the plurality of attachments.

12. The apparatus as claimed in claim 11 wherein each of the plurality of attachments has a length of about one inch, and wherein the combined length of the elongated body and one of the attachments does not greatly exceed the length of the firearm's barrel, whereby one of the attachments may be installed on the elongated body and left there, and whereby the elongated body may be subsequently placed in its storage position alongside the firearm's barrel without causing the installed attachment to protrude for an inordinate amount beyond the forward end of the firearm's barrel.

13. The apparatus as claimed in claim 11 wherein the threaded connection on each of the plurality of attachments includes a threaded stud having number 10–32 external threads.

14. The apparatus as claimed in claim 13 and further including a transverse bore passing through each of the plurality of attachments, and the bores being relatively smooth and having a diameter between the range of about 0.192 to about 0.200 inch, whereby the male stud of a first attachment may be inserted into the smooth bore of a second attachment in order to serve as a leverage member for tightening or loosening the second attachment with respect to the elongated body.

15. The apparatus as claimed in claim 1 wherein the elongated body is made of a material selected from the group comprising steel, aluminum, brass, plastic, and reinforced carbon, and wherein said elongated body has a relatively uniform diameter of about 0.360 inch.

16. The apparatus as claimed in claim 1 wherein the firearm's bore has a length within the range of about 6 to about 46 inches, and wherein the elongated body has a length that is not more than two inches shorter than the bore's length.

17. A ramrod having utility in preparing a firearm for firing, said firearm being of the type that uses black powder as a propellant and is sometimes referred to as a muzzleloader, and the firearm having a bore into which is placed a charge of black powder and a projectile prior to firing, comprising:

a) an elongated body having a first and a second end and a length therebetween, and the body's length being sufficient so that the body's first end may be inserted into the bore of a firearm in order to tamp a projectile prior to igniting a charge of powder in the firearm, and the elongated body having an exterior size and shape that is approximately the same as that of the firearm's bore, and the elongated body having a transverse and generally circular cross-sectional area; and b) a structural member attached to and carried by the elongated body at all times, and the structural member being selectively movable between a stowed configuration and a working configuration, and the stowed configuration being one in which the transverse cross-sectional area of the structural member is not more than about 40% larger than the transverse cross-sectional area of the elongated body, and the working configuration being one in which there is an area against which a manual force may be applied that is at least 100% greater than the transverse cross-sectional area of the elongated body, whereby a substantially greater area is available for the application of a manual force on the structural member when the structural member has been moved from its stowed configuration to its working configuration.

18. The method of facilitating the installation and removal of accessories on the distal end of a ramrod for a muzzle-loading firearm, said ramrod having a longitudinal axis, comprising the steps of:

a) establishing a set of accessories, with each of the accessories in the set having utility in the efficient use of a muzzle-loading firearm, and each of the accessories having a body and a threaded stud protruding therefrom, said studs being sized and configured for engagement with a threaded bore in the distal end of a ramrod, and said threaded bore being coaxial with the longitudinal axis of the ramrod;

b) providing a transverse bore in the body of each of the accessories, and the diameter of the transverse bore being just slightly greater than the diameter of the threaded stud of each accessory;

c) after a first accessory has been threadably engaged with the ramrod, inserting the threaded stud of a second accessory into the transverse bore of the first accessory; and d) applying torque to the first accessory by exerting a transverse force on the second accessory, whereby the engagement of a first accessory with a ramrod may be selectively tightened or loosened by exerting a force on the second accessory in a direction that is transverse to the longitudinal axis of the ramrod.

19. A ramrod assembly for use with that class of firearms known as muzzleloaders, compromising the combination of:

a) a first elongated member having a front end and a rear end, and the rear end being configured in such a way that a manual force may be applied to the rear end by a user;

b) a set of elongated extension members configured so that they may be connected to form a serial array of elongated members in front of the first elongated member when selected ones of the members are sequentially joined together, such that a manual force applied to the rear end of the first elongated member can be transferred through those ones of the extension members that are joined together at any given time in front of the first elongated member;

c) threaded means for joining together adjacent ends of the first elongated member and selected ones of the set of extension members, and said threaded means including a male threaded element and a complementary female threaded element, and each of the extension members having a length of at least two inches; and d) a transverse bore in each one of the set of extension members, said bore having a diameter to receive with a loose fit the male element of said threaded means for joining together respective members, such that a given one of the extension members can be oriented transversely to a serial array of members, and the male element of that transversely oriented member can be inserted into an appropriate transverse bore and utilized to apply leverage to tighten or loosen the threaded joint between two of the connected members.

20. The ramrod assembly as claimed in claim 19 wherein the male and female elements of the threaded means have number 10–32 threads, and the male element is about ⅜ inch long.

21. The ramrod assembly as claimed in claim 19 wherein the transverse bore in an extension member is smooth and has a diameter of at least 0.192 inch.

22. The ramrod assembly as claimed in claim 19 wherein at least four of the extension members have different lengths, and said at least four extension members differ in their respective lengths by increments of about one inch, and the four extension members range in length between three inches and six inches.

* * * * *